US010692363B1

(12) United States Patent
Kumar Srivastava et al.

(10) Patent No.: US 10,692,363 B1
(45) Date of Patent: Jun. 23, 2020

(54) METHOD AND SYSTEM FOR DETERMINING PROBABILITY OF AN ALARM GENERATED BY AN ALARM SYSTEM

(71) Applicant: WIPRO LIMITED, Bangalore (IN)

(72) Inventors: Anurag Kumar Srivastava, Gorakhpur (IN); Utkarsh Bhakne, Chhindwara (IN)

(73) Assignee: Wipro Limited, Bangalore (IN)

( * ) Notice: Subject to any disclaimer, the term of this patent is extended or adjusted under 35 U.S.C. 154(b) by 0 days.

(21) Appl. No.: 16/260,199

(22) Filed: Jan. 29, 2019

(30) Foreign Application Priority Data

Nov. 30, 2018 (IN) ..... 201841045374

(51) Int. Cl.

| | |
|---|---|
| ***G08B 23/00*** | (2006.01) |
| ***G08B 29/18*** | (2006.01) |
| ***G08B 29/06*** | (2006.01) |
| ***G08B 29/04*** | (2006.01) |

(52) U.S. Cl.
CPC ..... *G08B 29/188* (2013.01); *G08B 29/04* (2013.01); *G08B 29/06* (2013.01); *G08B 29/183* (2013.01)

(58) Field of Classification Search
CPC .... G08B 29/186; G08B 29/185; G08B 23/00; G08B 21/00; G08B 19/00
See application file for complete search history.

(56) References Cited

U.S. PATENT DOCUMENTS

| | | | | |
|---|---|---|---|---|
| 4,356,476 | A | 10/1982 | Healey et al. | |
| 4,808,972 | A | 2/1989 | Nicholls | |
| 7,639,128 | B2 | 12/2009 | Kogan et al. | |
| 9,013,294 | B1 * | 4/2015 | Trundle ..... | G08B 25/001 340/501 |
| 2008/0272902 | A1 | 11/2008 | Kang et al. | |

* cited by examiner

*Primary Examiner* — Hongmin Fan
(74) *Attorney, Agent, or Firm* — Finnegan, Henderson, Farabow, Garrett & Dunner, LLP

(57) ABSTRACT

This disclosure relates to method and system for determining probability of an alarm generated by an alarm system. The method may include receiving sensor data and maintenance data. The sensor data may include one or more environmental parameters and one or more trigger parameters, and the alarm is generated based on the one or more trigger parameters. The method may further include generating one or more input vectors based on the sensor data and the maintenance data, and determining a spuriosity index of the alarm based on the one or more input vectors using a machine learning model. The machine learning model may be created using historical sensor data and historical maintenance data, and the spuriosity index is indicative of the probability of the alarm.

19 Claims, 5 Drawing Sheets

METHOD AND SYSTEM FOR DETERMINING PROBABILITY OF AN ALARM GENERATED BY AN ALARM SYSTEM

TECHNICAL FIELD

This disclosure relates generally to alarm systems, and more particularly to a method and system for determining spuriosity of an alarm generated by an alarm system.

BACKGROUND

Alarm systems play a vital role in ensuring a safe working environment across different industries. One or more alarm systems may be deployed in an industrial facility for detecting and alerting working personnel about unsafe working conditions. For example, alarm systems may be deployed in an oil & gas industrial facility, such as oil field, for detecting high concentration of harmful substances, such as Hydrogen Sulfide ($H_2S$). Accurate detection and alerting by the alarm systems largely depend on the working of the sensors deployed in the industrial facility. It is observed that accuracy of the sensors may be influenced by environmental factors, such as ambient temperature, ambient pressure, ambient humidity, and the like. In other words, the sensors work well as long as the environmental factors are within a designed specification ranges. However, the accuracy of the sensors may be severely impacted in extreme climatic conditions, such as very low or very high temperature, high humidity, heavy rains, and the like. As a result, in such scenarios, the alarm system may get triggered even when the working conditions (for example, concentration of toxic substances) are within safe limits. For example, in extreme climatic conditions, an alarm for alerting about dangerously high concentration of $H_2S$ in a working environment may get falsely triggered even when the amount of the $H_2S$ is in safe limits. Such a false alarm may be called a spurious alarm.

As will be appreciated, when a spurious alarm is triggered in an industrial facility, various measures and safety protocols may be initiated so as to ensure safety and wellbeing of the working personnel. For example, these measures and safety protocols may include activating shutdown, initiating investigation, instrument maintenance, and so on. Thus, such spurious alarms, especially in remotely located locations, may lead to unnecessary expenses. Further, if frequency of such spurious alarms is high, overall operation cost may rise exponentially. Moreover, the spurious alarms may also lead to unnecessary fatigue amongst the working personnel, such as field engineers, which in turn may result in hazard due to negligence.

Current techniques to detect spurious alarms are limited in their efficacy and utility. For example, one of the techniques provide for monitoring status of alarm detectors. The technique may provide a command signal only when one or more of pre-defined alarm detectors are simultaneously triggered. However, the technique does not take into account various factors that trigger generation of spurious alarms, and, therefore, fails to detect spurious alarms in an effective manner. Further, current techniques lack intelligence and rely purely on user experience to determine correctness of any alarm.

SUMMARY

In one embodiment, a method for determining spuriosity of an alarm generated by an alarm system is disclosed. In one example, the method may include receiving sensor data and maintenance data, such that the sensor data may include one or more environmental parameters and one or more trigger parameters. The alarm may be generated based on the one or more trigger parameters. The method may further include generating one or more input vectors based on the sensor data and the maintenance data. The method may further include determining a spuriosity index of the alarm based on the one or more input vectors using a machine learning model, such that the machine learning model is created using historical sensor data and historical maintenance data. The spuriosity index may be indicative of the spuriosity of the alarm.

In one embodiment, a system for determining spuriosity of an alarm generated by an alarm system is disclosed. In one example, the system may include an alarm validation device, which may include at least one processor and a computer readable medium coupled to the at least one processor. The computer readable medium may store instructions, which on execution, may cause the at least one processor to receive sensor data and maintenance data, such that the sensor data may include one or more environmental parameters and one or more trigger parameters. The alarm may be generated based on the one or more trigger parameters. The processor-executable instructions, on execution, may further cause the at least one processor to generate one or more input vectors based on the sensor data and the maintenance data. The processor executable instructions, on execution, may further cause the at least one processor to determine a spuriosity index of the alarm based on the one or more input vectors using a machine learning model, such that the machine learning model is created using historical sensor data and historical maintenance data. The spuriosity index may be indicative of the spuriosity of the alarm.

In one embodiment, a non-transitory computer readable medium storing computer-executable instructions for determining spuriosity of an alarm generated by an alarm system is disclosed. In one example, the stored instructions, when executed by a processor, may cause the processor to perform operations including receiving sensor data and maintenance data, such that the sensor data may include one or more environmental parameters and one or more trigger parameters. The alarm may be generated based on the one or more trigger parameters. The operations may further include generating one or more input vectors based on the sensor data and the maintenance data. The operations may further include determining a spuriosity index of the alarm based on the one or more input vectors using a machine learning model, such that the machine learning model is created using historical sensor data and historical maintenance data. The spuriosity index may be indicative of the spuriosity of the alarm.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Figure 1:
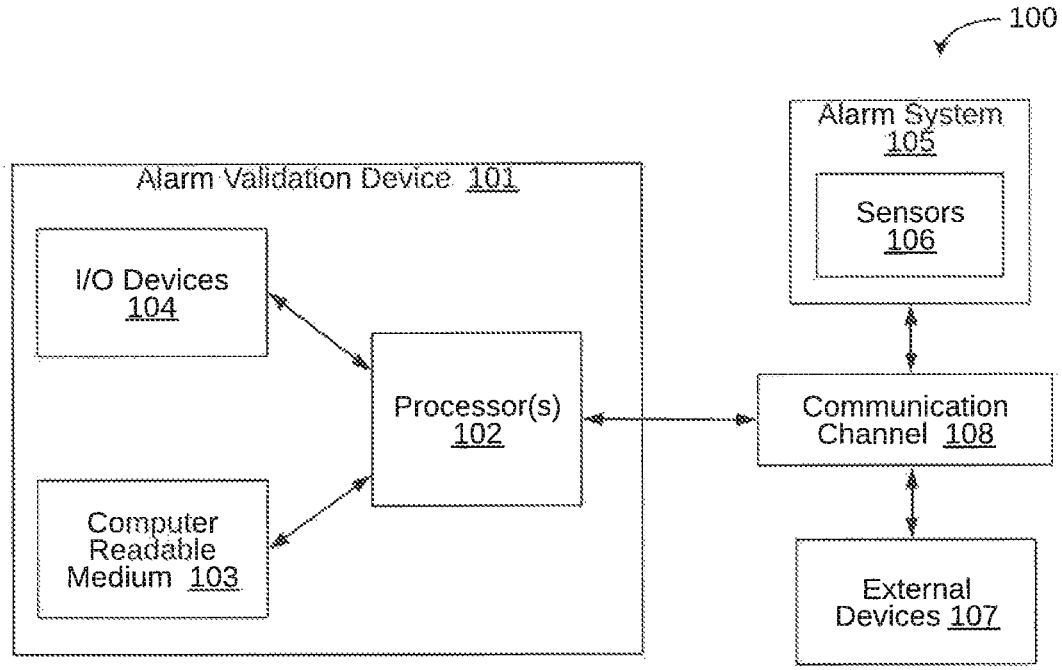
FIG. 1 is a block diagram of an exemplary system for determining spuriosity of an alarm generated by an alarm system, in accordance with some embodiments of the present disclosure.

Referring now to FIG. 1, an exemplary system 100 for determining spuriosity of an alarm generated by an alarm system 105 is illustrated, in accordance with some embodiments of the present disclosure. In particular, the system 100 may implement an alarm validation device 101 for determining spuriosity of an alarm generated by the alarm system 105. The alarm system 105 may be installed in any facility (for example, industrial facility, warehouse, residential house, and the like) so as to detect trigger parameters (for example, any hazardous substance, hazardous condition, and the like.) and to generate an alarm based on the detected trigger parameters. The alarm system 105 may include various sensors 106 that may be configured for capturing the trigger parameters and environmental parameters. As stated above, the alarm may be generated even when the trigger parameters conform to safe limits due to the extreme environmental conditions. The alarm validation device 101 may, therefore, determine spuriosity of the alarm generated by the alarm system 105.

As will be described in greater detail in conjunction with FIGS. 2-4, the alarm validation device 101 may receive sensor data (that is, the environmental parameters and the trigger parameters) and maintenance data, generate one or more input vectors based on the sensor data and the maintenance data, and determine a spuriosity index of the alarm (indicative of the spuriosity of the alarm) based on the one or more input vectors using a machine learning model. It may be further noted that the machine learning model may be created using historical sensor data and historical maintenance data.

The alarm validation device 101 may include, but may not be limited to, server, desktop, laptop, notebook, netbook, tablet, smartphone, and mobile phone. In particular, the alarm validation device 101 may include one or more processors 102, a computer readable medium 103 (for example, a memory), and input/output devices 104. The computer readable medium 103 may store instructions that, when executed by the one or more processors 102, cause the one or more processors 102 to determine spuriosity of an alarm generated by the alarm system 105, in accordance with aspects of the present disclosure. The computer readable medium 103 may also store various data (for example, sensor data, maintenance data, input vectors, spuriosity index, machine learning model, historical data, user assessment data, process data, and the like) that may be captured, processed, and/or required by the alarm validation device 101. The alarm validation device 101 may interact with a user (not shown) via input/output devices 104. The alarm validation device 101 may interact with the alarm system 105 over a communication network 108. The alarm validation device 101 may also interact with one or more external devices 107 over the communication network 108 for sending or receiving various data. The one or more external devices 107 may include, but are not limited to, a remote server, a digital device, or another computing system.

Figure 2:
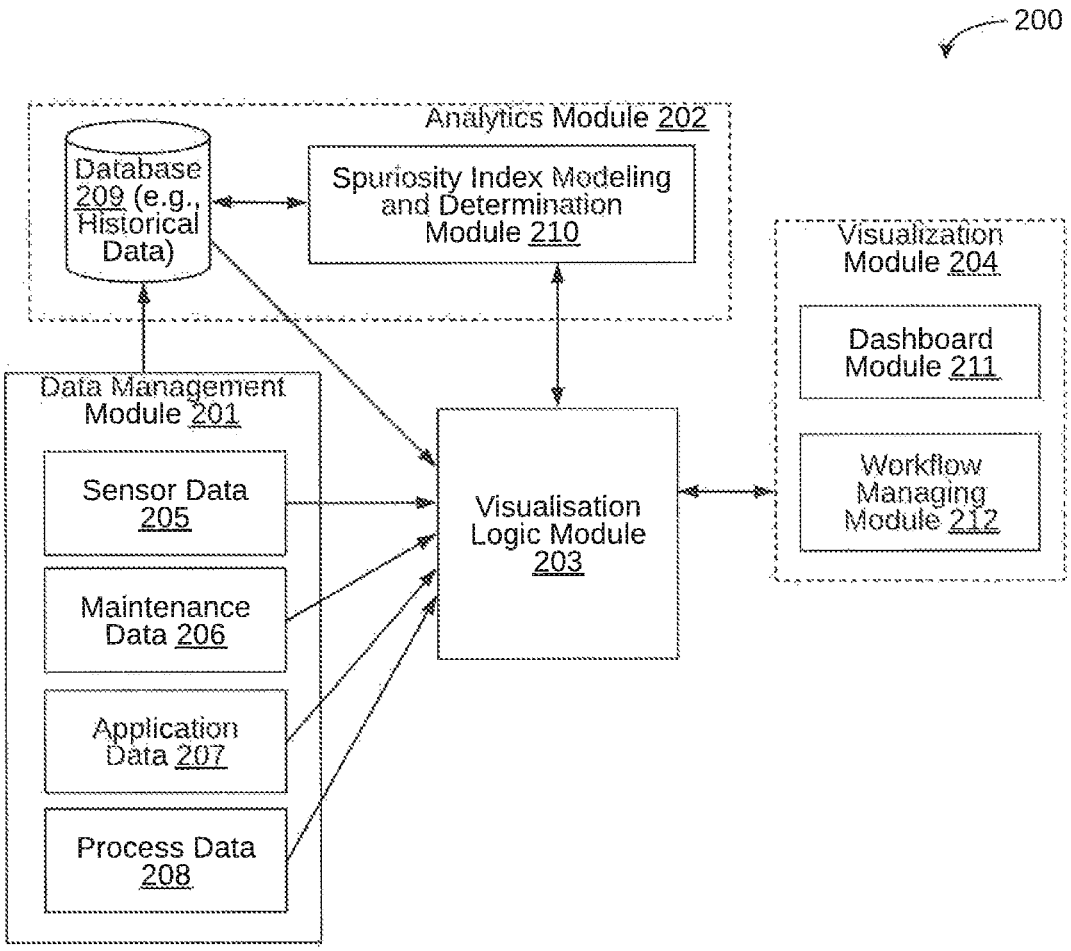
FIG. 2 is a functional block diagram of an alarm validation device, implemented by the system of FIG. 1, in accordance with some embodiments of the present disclosure.

Referring now to FIG. 2, a functional block diagram of the alarm validation device 200, analogous to the alarm validation device 101 implemented by the system 100 of FIG. 1, is illustrated in accordance with some embodiments of the present disclosure. The alarm validation device 200 may include various modules that perform various functions so as to determine spuriosity of an alarm generated by an alarm system. In some embodiments, the alarm validation device 200 may include a data management module 201, an analytics module 202, a visualization logic module 203, and a visualization module 204. In some embodiments, the data management module 201 may receive various data, such as sensor data 205, maintenance data 206, application data 207, and process data 208. The analytics module 202 may include a database 209 and a spuriosity index modeling and determination module 210. The visualization module 204 may include a dashboard module 211 and a workflow managing module 212. As will be appreciated by those skilled in the art, all such aforementioned modules 201-204 and 210-212 and the database 209 may be represented as a single module or a combination of different modules. Moreover, as will be appreciated by those skilled in the art, each of the modules and the database may reside, in whole or in parts, on one device or multiple devices in communication with each other.

In some embodiments, the data management module 201 may acquire the sensor data 205 from one or more sensors 106. It may be noted that the one or more sensors may be configured to acquire various trigger parameters and various environmental parameters. The sensor data 205 may, therefore, include acquired environmental parameters and acquired trigger parameters. It may be noted that the environmental parameters may include real-time ambient parameters with respect to each of the sensors configured to acquire trigger parameters. Further, the real-time ambient parameters may include, but may not be limited to, an ambient temperature, an ambient humidity, an ambient pressure, or an ambient particulate matter. Similarly, it may be noted that the trigger parameters may include, but may not be limited to, a hazardous substance, or a hazardous condition. The hazardous substance may include, but may not be limited to, an inflammable gas, or a poisonous gas, while the hazardous condition may include, but may not be limited to, a build-up of one of the hazardous substances. As will be appreciated, the alarm system 105 may generate an alarm based on the one or more trigger parameters.

By way of an example, the sensor data may pertain to oil and gas (upstream) industry. As such, one or more sensors 106 may be deployed at different positions in an oil field so as to measure values of various parameters (for example, trigger and environmental parameters) of the oil well. For example, the sensors 106 may measure parameters including, but not limited to, pressure, influxes, temperature, valve status, and gas concentration. It may be understood that the sensors 106 may obtain various parameters in real-time. It may be further understood that the trigger parameters may be evaluated to trigger an alarm, if the trigger parameters are beyond a threshold limit.

Additionally, in some embodiments, the data management module 201 may acquire the maintenance data 206. The maintenance data 206 may include, but may not be limited to, a specification, an installation date, a calibration date, and a previous servicing date of each of the sensors 106 configured for acquiring the sensor data. The maintenance data 206 may further include power supply data for a monitored system configured to generate the trigger parameters. In some embodiments, the data management module 201 may receive the maintenance data 206 from the sensors 106 or from an external device 107. By way of an example, an exploration & production (E&P) company may record maintenance data for its instruments in a maintenance database. The maintenance data may be extracted from the maintenance database and referred to by maintenance personnel via a dashboard. The data management module 101 may extract maintenance data related to various instruments of the alarm system 105 (for example, sensors) by leveraging the maintenance database. In alternate embodiments, the data management module 201 may receive the maintenance data 206 from users via input/output devices 104.

Further, in some embodiments, the data management module 201 may acquire the application data 207 and the process data 208. The application data 207 may include, but may not be limited to, user profiles, event logs, transaction logs, facility details, group policies, and validations. By way of an example, a company may store the application data 207 in a centralized data repository. The application data 207 may be accessed, modified or manipulated by a visualization logic module 203 so as to provide valuable insights to the user. In some embodiments, the process data 208 may include information for creating process maps. The process maps may be created for providing a holistic view of the entire facility (for example, oil field). Once the process maps are created, the process maps may be displayed via the visualization module 204 to the user.

As stated above, the analytics module 202 may include the database 209 and the spuriosity index modeling and determination module 210. The database 209 may implement a historical data repository so as to store historical data. By way of an example, the historical data repository may store historical sensor data, historical maintenance data, historical application data, and historical process data. The historical data repository may further store historical data with respect to past alarm events and their corresponding spuriosity indices. In other words, historical data repository may store data points of scenarios when true or false alarms were triggered in the past in a facility (for example, of an E&P company). The database 209 may be communicatively coupled to the data management module 201. The database 209 may receive various data (that is, the sensor data 205, the maintenance data 206, the application data 207, and the process data 208) from the data management module 201. Upon receiving, the database 209 may store the various data as historical data (that is, historical sensor data, historical maintenance data, historical application data, and historical process data) in the historical data repository for subsequent use. The database 209 may also be communicatively coupled to the spuriosity index modeling and determination module 210. The database 209 may receive alarm event as well as spuriosity index for the alarm event from the spuriosity index modeling and determination module 210, and may store the same as historical data in the historical data repository. Further, the database 209 may receive user assessment of the alarm event from the visualization module 204 either directly or indirectly (for example, through spuriosity index modeling and determination 210), and may store the same as historical data in the historical data repository.

The spuriosity index modeling and determination module 210 may receive the historical data from the database 209, and may create a machine learning model so as to determine spuriosity index of an alarm for a given real-time input data. In particular, the spuriosity index modeling and determination module 210 may train the machine learning model using the historical data. The trained machine learning model may then provide spuriosity index for an alarm as an output, based on real-time input data. The real-time input data (that is, sensor data and the maintenance data) may be employed to generate input vectors, which may then be provided to the machine learning model. The spuriosity index is a Boolean value that may indicate if the alarm is true or not. Thus, for example, if the value of spuriosity index is 0, it may mean that the alarm is true and safety protocols needs to be activated. However, if the value is 1, it may mean that the alarm is false. Additionally, the spuriosity index modeling and determination module 210 may keep the historical data repository updated with the latest data and uses it for retuning the machine learning model at a regular frequency.

The visualization logic module 203 may be communicatively coupled to the data management module 201, and the database 209, and the spuriosity index modeling and determination module 210. The visualization logic module 203 may receive various real-time data (that is, the sensor data 205, the maintenance data 206, the application data 207, and the process data 208) from the data management module 201. The visualization logic module 203 may then transmit the received data to the spuriosity index modeling and determination module 210. Based on the data received from the visualization logic module 203, the spuriosity index modeling and determination module 210 may generate one or more input vectors to feed into the machine learning model, which may then determine a spuriosity index of the alarm. The spuriosity index modeling and determination module 210 may then send the spuriosity index determined for the real-time data to the visualization logic module 203.

The visualization logic module 203 may further receive the historical data (that is, the historical sensor data, the historical maintenance data, the historical application data, and the historical process data) from the database 209. Thus, the visualization logic module 203 may receive various real-time data from various sources via the data management module 201, the spuriosity index for the real-time data from the spuriosity index modeling and determination module 210, and the historical data from the historical data repository maintained within the database 209. Upon receiving the above mentioned data, the visualization logic module 203 may then integrate, validate and convert them into an appropriate format before presenting it to the user via the visualization module 204. In particular, the visualization logic module 203 may present the integrated and validated data to the user via the dashboard module 211 as per user's request.

The visualization module 204 may enable the alarm validation device 200 to interact with a user and vice versa. The visualization module 204 may be communicatively coupled to the visualization logic module 203 so as to facilitate interaction between the alarm validation device 200 and the user. As stated above, the visualization module 204 may include the dashboard module 211 and the workflow managing module 212. The dashboard module 211 may retrieve the integrated and validated data from the visualization logic module 203 and present it to the user, in a user-friendly manner, via a user interface. In some embodiments, the dashboard module 211 may organize the data, retrieved from the visualization logic module 203, in form of one or more tables, process diagrams, workflows, charts, and so forth. The dashboard module 211 may then present the organized information to the user via the user interface. It may be noted that, based on the presented data, the user may make an assessment regarding the spuriosity of the alarm. For example, the user may assess that an alarm event with spuriosity index of 0 is indeed true and initiate the safety measures and protocols. The dashboard module 211 may receive the user assessment via the user interface and provide the same to the alarm validation device 200 (for example, visualization logic module 203) for subsequent use (for example, for updating the historical data in the historical data repository with the latest sensor data, maintenance data, alarm, spuriosity index, and assessment; for retuning the machine learning model based on the updated historical data, or the like).

In some embodiments, the user may evaluate the presented data (that is, organized, integrated, and validated data including, but not limited to, real-time data, historical data, alarm notification, and spuriosity index), may provide an assessment, and may then perform a root cause analysis of the generated alarm. For example, the user may analyze why a certain spurious alarm was generated and how the same may be avoided in the future. The workflow managing module 212 may regularly update latest status of the root cause analysis performed by different users involved in tracking life cycle of an alarm from the time it is triggered until its closure. The workflow managing module 212 may further display the root cause analysis performed by the different users. The workflow managing module 212 may, therefore, ensure that accountabilities are assigned to appropriated users (that is, individuals or teams) for performing root cause analysis of the generated alarm and that the review and approval of the root cause analysis (for example, by other users at different time) is done correctly.

It should be noted that the alarm validation device 200 may be implemented in programmable hardware devices such as programmable gate arrays, programmable array logic, programmable logic devices, or the like. Alternatively, the alarm validation device 200 may be implemented in software for execution by various types of processors. An identified module of executable code may, for instance, include one or more physical or logical blocks of computer instructions which may, for instance, be organized as an object, procedure, function, or other construct. Nevertheless, the executables of an identified module need not be physically located together, but may include disparate instructions stored in different locations which, when joined logically together, comprise the module and achieve the stated purpose of the module. Indeed, a module of executable code may be a single instruction, or many instructions, and may even be distributed over several different code segments, among different applications, and across several memory devices.

Figure 3:
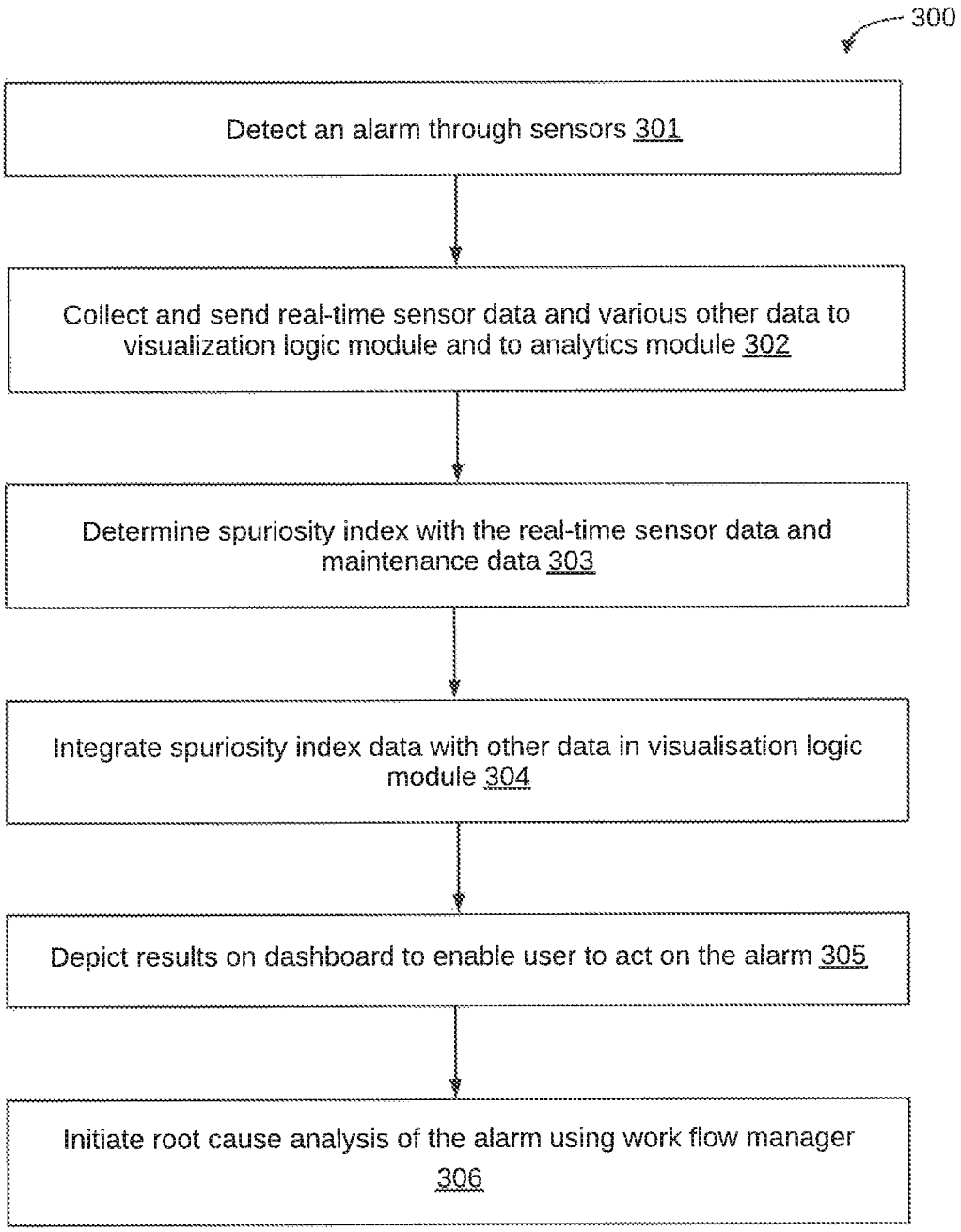
FIG. 3 is a flow diagram of an exemplary process overview for determining spuriosity of an alarm, in accordance with some embodiments of the present disclosure.

Referring now to FIG. 3, an overview of an exemplary process 300 for determining spuriosity of an alarm is depicted via a flowchart, in accordance with some embodiments of the present disclosure. At step 301, the alarm system 105 may detect an alarm through sensors 106 and provide the same to the alarm validation device 101. Further, at step 302, the alarm validation device 101 may collect real-time sensor data and various other data from one or more data sources via the data management module 201 and send the collected data to the visualization logic module 203 and further to the analytics module 202. Further, at step 303, the alarm validation device 101 may calculate spuriosity index of the alarm based on the real-time sensor data and maintenance data using a machine learning model built and trained by the analytics module 202. Further, at step 304, the alarm validation device 101 may integrate spuriosity index data with other data in the visualization logic module 203. Further, at step 305, the alarm validation device 101 may depict results to the user on the dashboard provided by the visualization module 204 in order to enable the user to act on the alarm. Moreover, in some embodiments, at step 306, the alarm validation device 101 may initiate root cause analysis of the alarm using the workflow manager provided by the visualization module 204.

At step 301, the alarm system 105 may detect trigger parameters through the sensors 106, and may determine if the trigger parameters exceed pre-defined thresholds so as to generate an alarm. By way of an example, when concentration of a harmful substance (for example, Hydrogen Sulfide gas) detected by the sensors 106 is determined to be beyond a pre-defined threshold limit, the alarm system 105 may generate an alarm for notifying users of a potential hazardous occurrence. It should be noted that the sensors 106 may also detect environmental parameters associated with each of the sensors 106, which are configured to detect the trigger parameters.

At step 302, the real-time sensor data collected by the sensors 106 and acquired, from the sensors 106, by the data management module 201 may be sent to the visualization logic module 203, which may then initiate determination of spuriosity of the alarm generated by the alarm system 105. As stated above, the real-time sensor data may include environmental parameters (for example, ambient temperature, ambient humidity, and the like) as well as trigger parameters (for example, concentration of hazardous gas). The visualization logic module 203 may also receive the maintenance data (for example, last calibration date, maintenance frequency, and the like) acquired and subsequently sent by the data management module 201. The visualization logic module 203 may combine the real-time sensor data and the maintenance data and send the combined data to the spuriosity index modeling and determination module 210, implemented by the analytics module 202, for determination of the spuriosity index.

At step 303, the spuriosity index modeling and determination module 210 may determine the spuriosity index of the generated alarm based on the real-time sensor data and the maintenance data using a machine learning model. As will be appreciated by those skilled in the art, the spuriosity index may be indicative of the spuriosity of the generated alarm. In other words, the spuriosity index may indicate whether the generated alarm is valid or not. As stated above, the spuriosity index modeling and determination module 210 may build and train the machine learning model so as to provide the spuriosity index as an output. The machine learning model may be trained with historical data from the database 209. In some embodiments, the machine learning model may be fed with one or more input vectors derived from the real-time sensor data and the maintenance data. Further, the spuriosity index modeling and determination module 210 may update the historical data repository implemented by the database 209 with the latest sensor data, the latest maintenance data, the generated alarm, the spuriosity index for the generated alarm, and the user assessment of the generated alarm. As will be appreciated, the updated historical data may be employed to further tune the machine learning model. It should be noted that the tuning may be performed at regular interval. In some embodiments, the frequency of tuning may be based on the environmental parameters or the operating conditions. Additionally, the spuriosity index modeling and determination module 210 may provide the spuriosity index determined for the generated alarm to the visualization logic module 203.

At step 304, the visualization logic module 203 may compile the spuriosity index data received from the spuriosity index modeling and determination module 210 with other data (for example, real-time sensor data, maintenance data, application data, process data, or the like) received from the data management module. Further, the visualization logic module 203 may send the compiled data to the dashboard module 211. The dashboard module 211 may convert the information received from the visualization logic module 203 into a tabular/graphical format so as to convey the information and insight generated from the information to the user in an easily understandable format. The user (for example, a control room engineer) may then take a decision to act on the generated alarm or to ignore the alarm based on the system insights.

At step 305, the maintenance data, the application data, the process data, the real-time sensor data, the generated alarm, and the associated spuriosity index may be displayed via the dashboard module 211. As stated above, the information may be displayed in an integrated and user friendly format (for example, tabular format or graphical format) for ease of consumption and understanding of the user. It may be noted that the user may analyze the displayed information and may accordingly decide whether the generated alarm is false or true. In particular, the user may evaluate the real-time sensor data and other data, along with the spuriosity index of the alarm for decision making. If the user concludes that the generated alarm is true, then the alarm validation device may initiate the security measures and protocols. However, if the user concludes that the generated alarm is false (that is the alarm is spurious), then the generated alarm may be suppressed, and the facility personnel may continue their work normally.

At step 306, a root cause analysis of the alarm may be initiated using the workflow managing module 212. As will be appreciated, the best way to understand, mitigate and prevent operational disruption may be through the root cause analysis of the generated alarm. The root cause analysis may include identifying the root cause resulting in generation of the alarm or the spurious alarm, addressing the identified root cause (for example, fixing one or more problems), and putting in place preventive measures to avoid similar incidents in future (for example, defining of workflow for resolution of identified problem). In some embodiments, the root cause analysis may further include process oriented impact analysis. Further, to ensure that the root cause analysis is performed properly, the user (for example, an engineer in charge) may assign tasks to other users (for example, technicians), and review their report on respective tasks. The engineer may keep track of the progress of the root cause analysis using the workflow managing module 212. In some embodiments, after the action items devised for the root cause analysis is completed, reviewed and approved, an alarm analysis checklist may be marked complete and the root cause analysis of the alarm may be closed. Additionally, a report on the root cause analysis may be viewed using the dashboard module 211 on a user's request.

As will be appreciated by one skilled in the art, a variety of processes may be employed for determining spuriosity of an alarm generated by an alarm system. For example, the exemplary system 100 and the associated alarm validation device 200 may determine spuriosity of an alarm generated by the alarm system by the processes discussed herein. In particular, as will be appreciated by those of ordinary skill in the art, control logic and/or automated routines for performing the techniques and steps described herein may be implemented by the system 100 and the associated alarm validation device 200, either by hardware, software, or combinations of hardware and software. For example, suitable code may be accessed and executed by the one or more processors on the system 100 to perform some or all of the techniques described herein. Similarly application specific integrated circuits (ASICs) configured to perform some or all of the processes described herein may be included in the one or more processors on the system 100.

Figure 4:
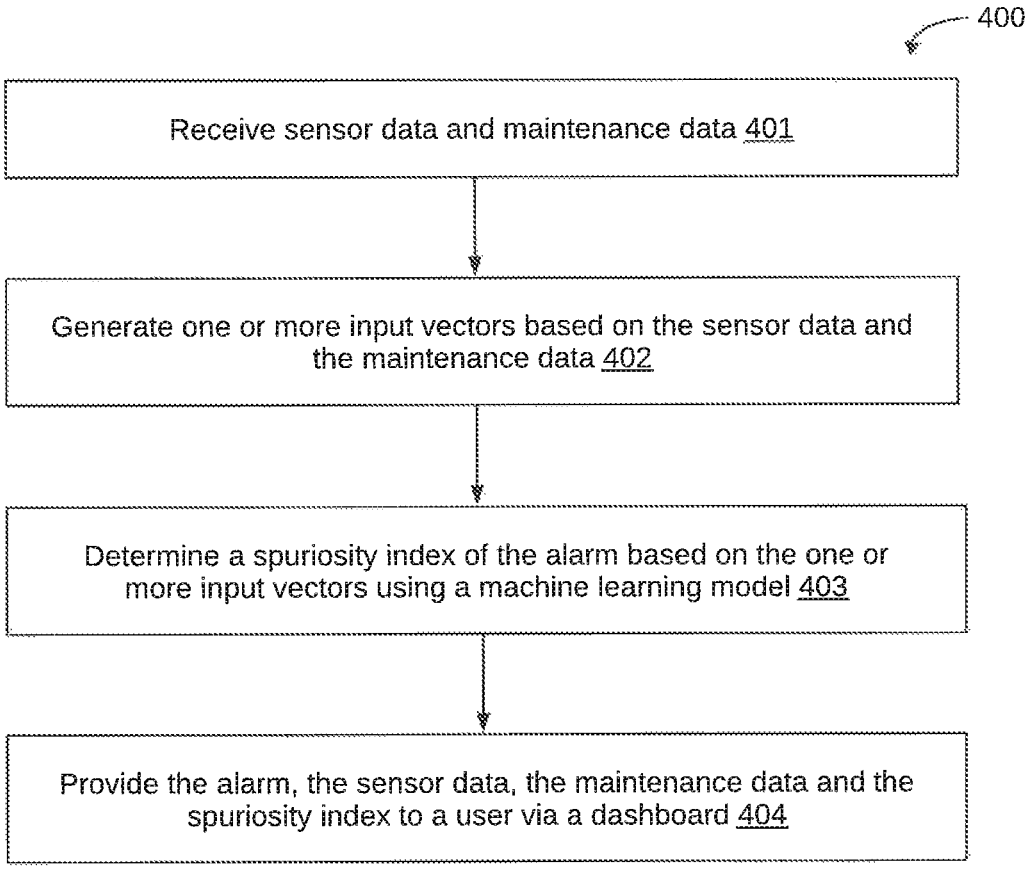
FIG. 4 is a flow diagram of an exemplary process for determining spuriosity of an alarm generated by an alarm system, in accordance with some embodiments of the present disclosure.

Referring now to FIG. 4, an exemplary control logic 400 for determining spuriosity of an alarm generated by an alarm system via a system, such as the system 100, is depicted via a flowchart, in accordance with some embodiments of the present disclosure. As illustrated in the flowchart, the control logic 400 may include the steps of receiving sensor data and maintenance data at step 401, generating one or more input vectors based on the sensor data and the maintenance data at step 402, and determining a spuriosity index of the alarm based on the one or more input vectors using a machine learning model at step 403. It should be noted that the sensor data may include one or more environmental parameters and one or more trigger parameters. Further, it should be noted that the machine learning model may be created using historical sensor data and historical maintenance data. As will be appreciated, the alarm may be generated based on the one or more trigger parameters (for example, when the trigger parameters are beyond their respective safe limits) and the spuriosity index may be indicative of the spuriosity of the alarm (that is, whether the generated alarm is true or false).

In some embodiments, the control logic 400 may further include the step of providing the alarm, the sensor data, the maintenance data, and the spuriosity index to a user via a dashboard at step 404. Additionally, in some embodiments, the control logic 400 may include the step of receiving an assessment from the user on the spuriosity of the alarm (for example, whether the generated alarm having a spuriosity index as '0' is indeed true or not). Further, in some embodiments, the control logic 400 may include the step of updating a historical data repository with the sensor data, the maintenance data, the alarm, the spuriosity index, and the assessment. Further, in some embodiments, the control logic 400 may include the step of retuning the machine learning model based on updated historical data from the historical data repository. It should be noted that, in such embodiments, a frequency of retuning is based on the one or more environmental parameters and one or more operating conditions.

In some embodiments, the one or more environmental parameters may include one or more real-time ambient parameters with respect to each of one or more sensors 106. It should be noted that the one or more sensors 106 may be configured for acquiring the one or more trigger parameters. The one or more real-time ambient parameters may include an ambient temperature, an ambient humidity, an ambient pressure, or an ambient particulate matter. Additionally, in some embodiments, the one or more trigger parameters may include one or more hazardous substances, or one or more hazardous conditions. As will be appreciated by those skilled in the art, the one or more hazardous substances may include an inflammable gas, or a poisonous gas, and the one or more hazardous conditions may include a build-up of the one or more hazardous substances. Further, in some embodiments, the maintenance data 206 may include one or more specifications, an installation date, a calibration date, or one or more previous servicing dates of the one or more sensors 106 configured for acquiring the sensor data. Moreover, in some embodiments, the maintenance data 206 may include power supply data for a monitored system configured to generate the one or more trigger parameters.

In some embodiments, the control logic 400 may further include the step of adjusting one or more conditions for generation of the alarm based on the spuriosity index and the assessment. For example, in normal environmental conditions, the alarm may be generated when the trigger parameters are across a predetermined threshold 'T'. However, in abnormal environmental conditions, a spurious alarm may be generated when even the trigger parameters are within the threshold 'T' that is at a threshold 'T–t'. Therefore, a user, upon assessment, may adjust the predetermined threshold to 'T+t' so as to counterbalance the environmental conditions and prevent the spurious alarm.

As will be also appreciated, the above described techniques may take the form of computer or controller implemented processes and apparatuses for practicing those processes. The disclosure can also be embodied in the form of computer program code containing instructions embodied in tangible media, such as floppy diskettes, solid state drives, CD-ROMs, hard drives, or any other computer readable medium, wherein, when the computer program code is loaded into and executed by a computer or controller, the computer becomes an apparatus for practicing the invention. The disclosure may also be embodied in the form of computer program code or signal, for example, whether stored in a storage medium, loaded into and/or executed by a computer or controller, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

Figure 5:
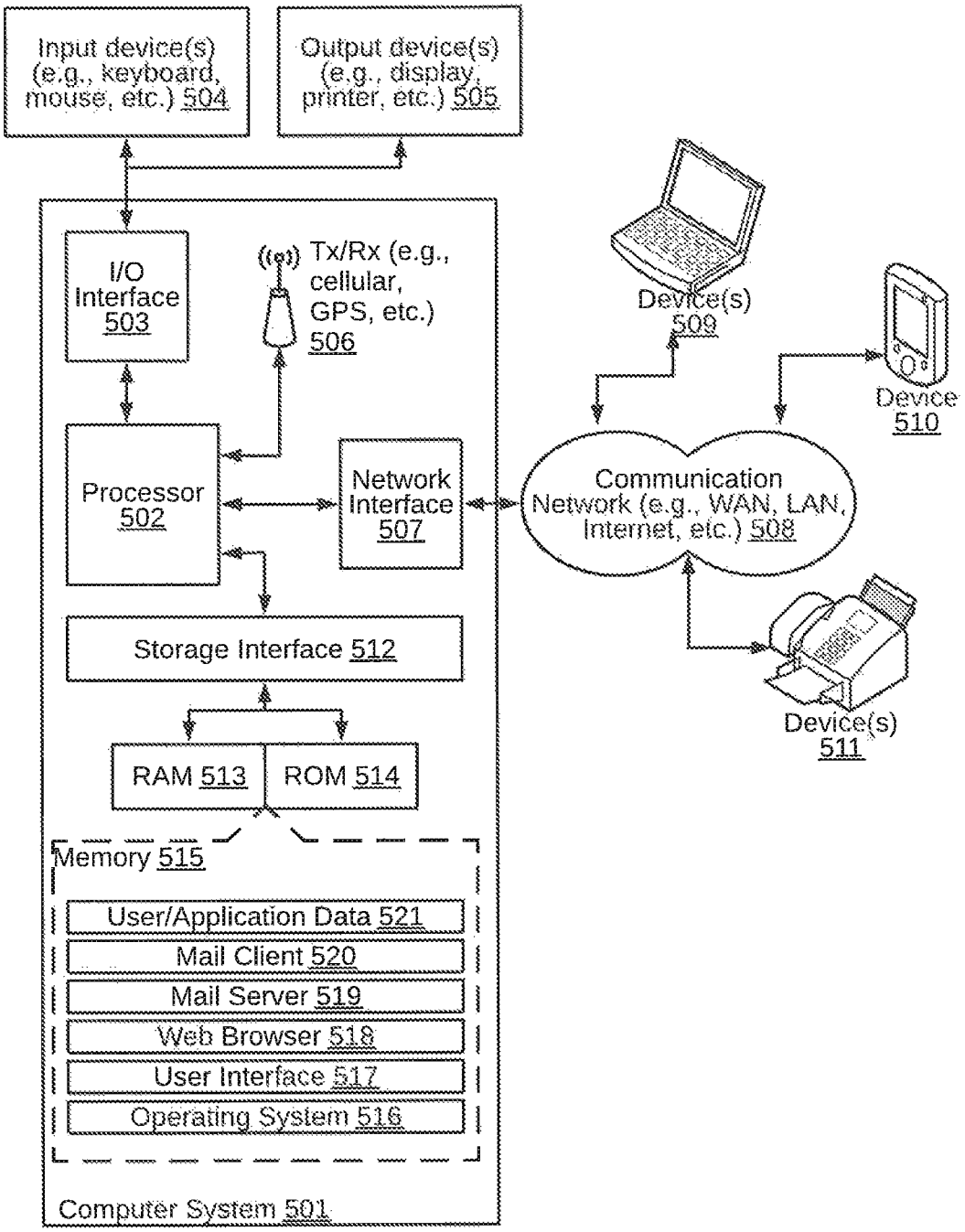
FIG. 5 is a block diagram of an exemplary computer system for implementing embodiments consistent with the present disclosure.

The disclosed methods and systems may be implemented on a conventional or a general-purpose computer system, such as a personal computer (PC) or server computer. Referring now to FIG. 5, a block diagram of an exemplary computer system 501 for implementing embodiments consistent with the present disclosure is illustrated. Variations of computer system 501 may be used for implementing system 100 for determining spuriosity of an alarm. Computer system 501 may include a central processing unit ("CPU" or "processor") 502. Processor 502 may include at least one data processor for executing program components for executing user-generated or system-generated requests. A user may include a person, a person using a device such as such as those included in this disclosure, or such a device itself. The processor may include specialized processing units such as integrated system (bus) controllers, memory management control units, floating point units, graphics processing units, digital signal processing units, and the like. The processor may include a microprocessor, such as AMD® ATHLON®, DURON® OR OPTERON®, ARM's application, embedded or secure processors, IBM® POWERPC®, INTEL® CORE® processor, ITANIUM® processor, XEON® processor, CELERON® processor or other line of processors, and the like. The processor 502 may be implemented using mainframe, distributed processor, multicore, parallel, grid, or other architectures. Some embodiments may utilize embedded technologies like application-specific integrated circuits (ASICs), digital signal processors (DSPs), Field Programmable Gate Arrays (FPGAs), and the like.

Processor 502 may be disposed in communication with one or more input/output (I/O) devices via I/O interface 503. The I/O interface 503 may employ communication protocols/methods such as, without limitation, audio, analog, digital, monoaural, RCA, stereo, IEEE-1394, near field communication (NEC), FireWire, Camera Link®, GigE, serial bus, universal serial bus (USB), infrared, PS/2, BNC, coaxial, component, composite, digital visual interface (DVI), high-definition multimedia interface (HDMI), radio frequency (RF) antennas, S-Video, video graphics array (VGA), IEEE 802.n/b/g/n/x, Bluetooth, cellular (for example, code-division multiple access (CDMA), high-speed packet access (HSPA+), global system for mobile communications (GSM), long-term evolution (LTE), WiMax, or the like), and the like.

Using the I/O interface 503, the computer system 501 may communicate with one or more I/O devices. For example, the input device 504 may be an antenna, keyboard, mouse, joystick, (infrared) remote control, camera, card reader, fax machine, dongle, biometric reader, microphone, touch screen, touchpad, trackball, sensor (for example, accelerometer, light sensor, GPS, altimeter, gyroscope, proximity sensor, or the like), stylus, scanner, storage device, transceiver, video device/source, visors, and the like. Output device 505 may be a printer, fax machine, video display (for example, cathode ray tube (CRT), liquid crystal display (LCD), light-emitting diode (LED), plasma, or the like), audio speaker, and the like. In some embodiments, a transceiver 506 may be disposed in connection with the processor 502. The transceiver may facilitate various types of wireless transmission or reception. For example, the transceiver may include an antenna operatively connected to a transceiver chip (for example, TEXAS INSTRUMENTS® WILINK WL1283®, BROADCOM® BCM47501UB8®, INFINEON TECHNOLOGIES® X-GOLD 618PMB9800® transceiver, or the like), providing IEEE 802.11a/b/g/n, Bluetooth, FM, global positioning system (GPS), 2G/3G HSDPA/HSUPA communications, and the like.

In some embodiments, the processor 502 may be disposed in communication with a communication network 508 via a network interface 507. The network interface 507 may communicate with the communication network 508. The network interface may employ connection protocols including, without limitation, direct connect, Ethernet (for example, twisted pair 10/100/1000 Base T), transmission control protocol/internet protocol (TCP/IP), token ring, IEEE 802.11a/b/g/n/x, and the like. The communication network 508 may include, without limitation, a direct interconnection, local area network (LAN), wide area network (WAN), wireless network (for example, using Wireless Application Protocol), the Internet, and the like. Using the network interface 507 and the communication network 508, the computer system 501 may communicate with devices 509, 510, and 511. These devices may include, without limitation, personal computer(s), server(s), fax machines, printers, scanners, various mobile devices such as cellular telephones, smartphones (for example, APPLE® IPHONE®, BLACKBERRY® smartphone, ANDROID® based phones, and the like), tablet computers, eBook readers (AMAZON® KINDLE®, NOOK®, and the like), laptop computers, notebooks, gaming consoles (MICROSOFT® XBOX®, NINTENDO® DS®, SONY® PLAYSTATION®, and the like), or the like. In some embodiments, the computer system 501 may itself embody one or more of these devices.

In some embodiments, the processor 502 may be disposed in communication with one or more memory devices (for example, RAM 513, ROM 514, and the like) via a storage interface 512. The storage interface may connect to memory devices including, without limitation, memory drives, removable disc drives, and the like, employing connection protocols such as serial advanced technology attachment (SATA), integrated drive electronics (IDE), IEEE-1394, universal serial bus (USB), fiber channel, small computer systems interface (SCSI), STD Bus, RS-232, RS-422, RS-485, I2C, SPI, Microwire, 1-Wire, IEEE 1284, Intel® QuickPathInterconnect, InfiniBand, PCIe, and the like. The memory drives may further include a drum, magnetic disc drive, magneto-optical drive, optical drive, redundant array of independent discs (RAID), solid-state memory devices, solid-state drives, and the like.

The memory devices may store a collection of program or database components, including, without limitation, an operating system 516, user interface application 517, web browser 518, mail server 519, mail client 520, user/application data 521 (for example, any data variables or data records discussed in this disclosure), and the like. The operating system 516 may facilitate resource management and operation of the computer system 501. Examples of operating systems include, without limitation, APPLE® MACINTOSH® OS X, UNIX, Unix-like system distributions (for example, Berkeley Software Distribution (BSD), FreeBSD, NetBSD, OpenBSD, and the like), Linux distributions (for example, RED HAT®, UBUNTU®, KUBUNTU®, and the like), IBM® OS/2, MICROSOFT® WINDOWS® (XP®, Vista/7/8, and the like), APPLE® IOS®, GOOGLE® ANDROID®, BLACKBERRY® OS, or the like. User interface 517 may facilitate display, execution, interaction, manipulation, or operation of program components through textual or graphical facilities. For example, user interfaces may provide computer interaction interface elements on a display system operatively connected to the computer system 501, such as cursors, icons, check boxes, menus, scrollers, windows, widgets, and the like. Graphical user interfaces (GUIs) may be employed, including, without limitation, APPLE® MACINTOSH® operating systems' AQUA®, IBM® OS/2®, MICROSOFT® WINDOWS® (for example, AERO®, METRO®, and the like), UNIX X-WINDOWS, web interface libraries (for example, ACTIVEX®, JAVA®, JAVASCRIPT®, AJAX®, HTML, ADOBE® FLASH®, and the like), or the like.

In some embodiments, the computer system 501 may implement a web browser 518 stored program component. The web browser may be a hypertext viewing application, such as MICROSOFT® INTERNET EXPLORER®, GOOGLE® CHROME®, MOZILLA® FIREFOX®, APPLE® SAFARI®, and the like. Secure web browsing may be provided using HTTPS (secure hypertext transport protocol), secure sockets layer (SSL), Transport Layer Security (TLS), and the like. Web browsers may utilize facilities such as AJAX®, DHTML, ADOBE® FLASH®, JAVASCRIPT®, JAVA®, application programming interfaces (APIs), and the like. In some embodiments, the computer system 501 may implement a mail server 519 stored program component. The mail server may be an Internet mail server such as MICROSOFT® EXCHANGE®, or the like. The mail server may utilize facilities such as ASP, ActiveX, ANSI C++/C #, MICROSOFT .NET®, CGI scripts, JAVA®, JAVASCRIPT®, PERL®, PHP®, PYTHON®, WebObjects, and the like. The mail server may utilize communication protocols such as internet message access protocol (IMAP), messaging application programming interface (MAPI), MICROSOFT® EXCHANGE®, post office protocol (POP), simple mail transfer protocol (SMTP), or the like. In some embodiments, the computer system 501 may implement a mail client 520 stored program component. The mail client may be a mail viewing application, such as APPLE MAIL®, MICROSOFT ENTOURAGE®, MICROSOFT OUTLOOK®, MOZILLA THUNDERBIRD®, and the like.

In some embodiments, computer system 501 may store user/application data 521, such as the data, variables, records, and the like (for example, sensor data, maintenance data, input vectors, spuriosity index, machine learning model, historical data, user assessment data, process data, and the like) as described in this disclosure. Such databases may be implemented as fault-tolerant, relational, scalable, secure databases such as ORACLE® OR SYBASE®. Alternatively, such databases may be implemented using standardized data structures, such as an array, hash, linked list, struct, structured text file (for example, XML), table, or as object-oriented databases (for example, using OBJECTSTORE®, POET®, ZOPE®, and the like). Such databases may be consolidated or distributed, sometimes among the various computer systems discussed above in this disclosure. It is to be understood that the structure and operation of the any computer or database component may be combined, consolidated, or distributed in any working combination.

As will be appreciated by those skilled in the art, the techniques described in the various embodiments discussed above provide for determining spuriosity of an alarm in an effective manner. The techniques provide for an intelligent system that may assist a user in determining whether an alarm generated by an alarm system is real or spurious, especially in hazardous industry. The intelligent system take into account various factors, such as environmental parameters, maintenance data, and the like, that may trigger the generation of a spurious alarm. In particular, the intelligent system take into account difference between designed and operating conditions of the alarm system. The intelligent system may be trained from historical datasets to account for learning from the past alarms (for example, from operational conditions vs designed conditions perspective). The trained intelligent system may then provide output based on real-time scenario. As described above, the values of real-time sensor data and maintenance data may be given as input vectors to the intelligent system, which may then give spuriosity index of the alarm as an output.

Further, as will be appreciated, the intelligent system may provide an integrated and user-friendly visualization of the information, such as real-time sensor data, maintenance data, application data, process data, historical data, spuriosity index of the alarm, and the like, to a user via an interactive dashboard. The user may provide a final assessment on the detected alarm along with a decision of acting on or suppressing the alarm. Further, as will be appreciated, the intelligent system may assist the user in identifying root cause of the generated alarm and, therefore, in proactive maintenance of the alarm system. Moreover, the intelligent system may be implemented over a cloud network for enhanced mobility.

Moreover, as will be appreciated, the intelligent system not only helps in detecting false alarms, but also suppressing false alarms. The detection and suppression of false alarms may not only help in improving credibility of the alarm system but also help in improving operation reliability and productivity of an industrial facility (for example, oil field) by decreasing undesired operational disruptions due to initiation of safety measures. As stated above, when an alarm is triggered a series of safety measures may be initiated so as to avoid loss of life and property. This may result in shutdown of the industrial facility for 4-8 hours. In adverse climatic conditions, such false alarms and accompanying operational disruptions may occur very frequently. Thus, the increased operational reliability and productivity may result in increased cost savings and increased profitability of the industrial facility.

The specification has described method and system for determining spuriosity of an alarm generated by an alarm system. The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, and the like, of those described herein) will be apparent to persons skilled in the relevant art(s) based on the teachings contained herein. Such alternatives fall within the scope and spirit of the disclosed embodiments.

Furthermore, one or more computer readable media may be utilized in implementing embodiments consistent with the present disclosure. A computer readable medium refers to any type of physical memory on which information or data readable by a processor may be stored. Thus, a computer readable medium may store instructions for execution by one or more processors, including instructions for causing the processor(s) to perform steps or stages consistent with the embodiments described herein. The term "computer readable medium" should be understood to include tangible items and exclude carrier waves and transient signals, that is, be non-transitory. Examples include random access memory (RAM), read-only memory (ROM), volatile memory, non-volatile memory, hard drives, CD ROMs, DVDs, flash drives, disks, and any other known physical storage media.

It is intended that the disclosure and examples be considered as exemplary only, with a true scope and spirit of disclosed embodiments being indicated by the following claims.

What is claimed is:

1. A method of determining probability of an alarm generated by an alarm system, the method comprising:

receiving, by an alarm validation device, sensor data and maintenance data, wherein the sensor data comprises one or more environmental parameters and one or more trigger parameters, and wherein the alarm is generated based on the one or more trigger parameters;

generating, by the alarm validation device, one or more input vectors based on the sensor data and the maintenance data; and determining, by the alarm validation device, a spuriosity index of the alarm based on the one or more input vectors using a machine learning model, wherein the machine learning model is created using historical sensor data and historical maintenance data, and wherein the spuriosity index is indicative of the probability of the alarm.

2. The method of claim 1, wherein the one or more environmental parameters comprise one or more real-time ambient parameters with respect to each of one or more sensors configured for acquiring each of the one or more trigger parameters, and wherein the one or more real-time ambient parameters comprise an ambient temperature, an ambient humidity, an ambient pressure, or an ambient particulate matter.

3. The method of claim 1, wherein the one or more trigger parameters comprise one or more hazardous substances, or one or more hazardous conditions, wherein the one or more hazardous substances comprise an inflammable gas, or a poisonous gas, and wherein the one or more hazardous conditions comprise a build-up of the one or more hazardous substances.

4. The method of claim 1, wherein the maintenance data comprises specifications, an installation date, a calibration date, or one or more previous servicing dates of one or more sensors configured for acquiring the sensor data, or power supply data for a monitored system configured to generate the one or more trigger parameters.

5. The method of claim 1, further comprising:

providing, by the alarm validation device, the alarm, the sensor data, the maintenance data, and the spuriosity index to a user via a dashboard.

6. The method of claim 5 further comprising:

receiving, by the alarm validation device, an assessment from the user on the probability of the alarm.

7. The method of claim 6, further comprising:

updating, by the alarm validation device, a historical data repository with the sensor data, the maintenance data, the alarm, the spuriosity index, and the assessment; and retuning, by the alarm validation device, the machine learning model based on updated historical data from the historical data repository.

8. The method of claim 7, wherein a frequency of retuning is based on the one or more environmental parameters and one or more operating conditions.

9. The method of claim 6, further comprising:

adjusting one or more conditions for generation of the alarm based on the spuriosity index and the assessment.

10. A system for determining probability of an alarm generated by an alarm system, the system comprising:

an alarm validation device comprising at least one processor and a non-transitory computer readable medium storing instructions that, when executed by the at least one processor, cause the at least one processor to perform operations comprising:

receiving sensor data and maintenance data, wherein the sensor data comprises one or more environmental parameters and one or more trigger parameters, and wherein the alarm is generated based on the one or more trigger parameters;

generating one or more input vectors based on the sensor data and the maintenance data; and determining a spuriosity index of the alarm based on the one or more input vectors using a machine learning model, wherein the machine learning model is created using historical sensor data and historical maintenance data, and wherein the spuriosity index is indicative of the probability of the alarm.

11. The system of claim 10, wherein the one or more environmental parameters comprise one or more real-time ambient parameters with respect to each of one or more sensors configured for acquiring each of the one or more trigger parameters, and wherein the one or more real-time ambient parameters comprise an ambient temperature, an ambient humidity, an ambient pressure, or an ambient particulate matter, or wherein the one or more trigger parameters comprise one or more hazardous substances, or one or more hazardous conditions, wherein the one or more hazardous substances comprise an inflammable gas, or a poisonous gas, and wherein the one or more hazardous conditions comprise a build-up of the one or more hazardous substances, or wherein the maintenance data comprises specifications, an installation date, a calibration date, or one or more previous servicing dates of one or more sensors configured for acquiring the sensor data, or power supply data for a monitored system configured to generate the one or more trigger parameters.

12. The system of claim 10, wherein the operations further comprise:

providing the alarm, the sensor data, the maintenance data, and the spuriosity index to a user via a dashboard; and receiving an assessment from the user on the probability of the alarm.

13. The system of claim 12, wherein the operations further comprise:

updating a historical data repository with the sensor data, the maintenance data, the alarm, the spuriosity index, and the assessment; and retuning the machine learning model based on updated historical data from the historical data repository, wherein a frequency of retuning is based on the one or more environmental parameters and one or more operating conditions.

14. The system of claim 12, wherein the operations further comprise:

adjusting one or more conditions for generation of the alarm based on the spuriosity index and the assessment.

15. A non-transitory computer readable medium storing computer-executable instructions for:

receiving sensor data and maintenance data, wherein the sensor data comprises one or more environmental parameters and one or more trigger parameters, and wherein the alarm is generated based on the one or more trigger parameters;

generating one or more input vectors based on the sensor data and the maintenance data; and determining a spuriosity index of the alarm based on the one or more input vectors using a machine learning model, wherein the machine learning model is created using historical sensor data and historical maintenance data, and wherein the spuriosity index is indicative of the probability of the alarm.

16. The non-transitory computer readable medium of the claim 15, wherein the one or more environmental parameters comprise one or more real-time ambient parameters with respect to each of one or more sensors configured for acquiring each of the one or more trigger parameters, and wherein the one or more real-time ambient parameters comprise an ambient temperature, an ambient humidity, an ambient pressure, or an ambient particulate matter, or wherein the one or more trigger parameters comprise one or more hazardous substances, or one or more hazardous conditions, wherein the one or more hazardous substances comprise an inflammable gas, or a poisonous gas, and wherein the one or more hazardous conditions comprise a build-up of the one or more hazardous substances, or wherein the maintenance data comprises specifications, an installation date, a calibration date, or one or more previous servicing dates of one or more sensors configured for acquiring the sensor data, or power supply data for a monitored system configured to generate the one or more trigger parameters.

17. The non-transitory computer readable medium of the claim 15, wherein the computer-executable instructions are further for:

providing the alarm, the sensor data, the maintenance data, and the spuriosity index to a user via a dashboard; and receiving an assessment from the user on the probability of the alarm.

18. The non-transitory computer readable medium of the claim 17, wherein the computer-executable instructions are further for:

updating a historical data repository with the sensor data, the maintenance data, the alarm, the spuriosity index, and the assessment; and retuning the machine learning model based on updated historical data from the historical data repository, wherein a frequency of retuning is based on the one or more environmental parameters and one or more operating conditions.

19. The non-transitory computer readable medium of the claim 17, wherein the computer-executable instructions are further for:

adjusting one or more conditions for generation of the alarm based on the spuriosity index and the assessment.

* * * * *